US006357518B1

(12) United States Patent
Sugimoto et al.

(10) Patent No.: US 6,357,518 B1
(45) Date of Patent: Mar. 19, 2002

(54) CORRUGATED FIN FOR HEAT EXCHANGER

(75) Inventors: Tatsuo Sugimoto, Okazaki; Takaaki Sakane; Kenichi Kachi, both of Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/495,195

(22) Filed: Jan. 31, 2000

(30) Foreign Application Priority Data

Feb. 1, 1999 (JP) ..... 11-024094

(51) Int. Cl.[7] ..... F28D 7/16; F28D 1/053
(52) U.S. Cl. ..... 165/140; 165/135; 165/152
(58) Field of Search ..... 165/135, 140, 165/152

(56) References Cited

U.S. PATENT DOCUMENTS 3,724,538 A 4/1973 Yamaguchi et al.
5,992,514 A * 11/1999 Sugimoto et al. ..... 165/135

FOREIGN PATENT DOCUMENTS

| | | |
|---|---|---|
| EP | 0 866 298 | 9/1998 |
| EP | 0 881 450 | 12/1998 |
| FR | 2576094 | 7/1986 |
| JP | 8-178366 | 7/1996 |
| JP | 9-280754 | 10/1997 |
| JP | 10-220977 | 8/1998 |

* cited by examiner

*Primary Examiner*—Leonard Leo
(74) *Attorney, Agent, or Firm*—Harness, Dickey & Pierce, PLC

(57) ABSTRACT

A corrugated fin for a double heat exchanger having a condenser and a radiator integrally includes a condenser fin and a radiator fin. Each of the condenser fin and the radiator fin has plural bent portions and plural flat portions each of which connects adjacent bent portions. A louver-forming processing amount of the flat portion of the condenser fin is set smaller than that of the flat portion of the radiator fin. Plural dimple-shaped plastically deformed portions are formed in the flat portion of the condenser fin, so that a whole processing amount of the condenser fin becomes substantially equal to that of the radiator fin. As a result, a radius of curvature of each bent portion of the condenser fin is substantially equal to that of the radiator fin, and the integrated fin is restricted from being deformed.

17 Claims, 9 Drawing Sheets

FIG. 6A
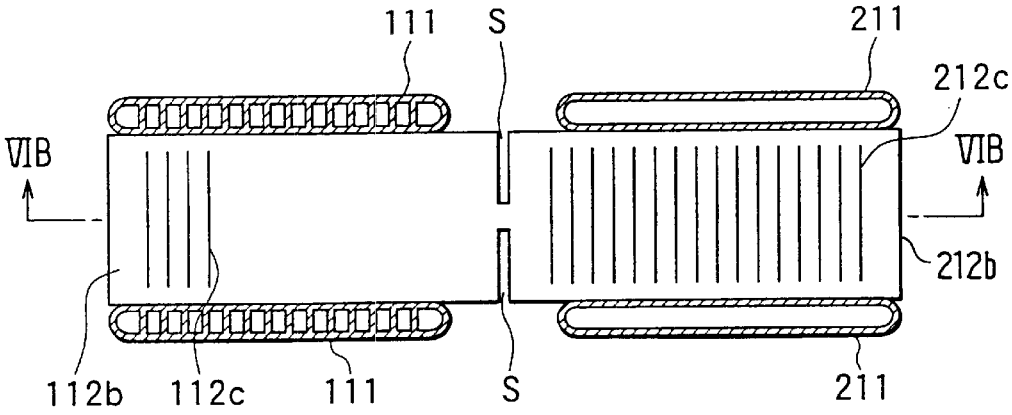
FIG. 6B
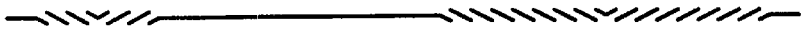
FIG. 7A
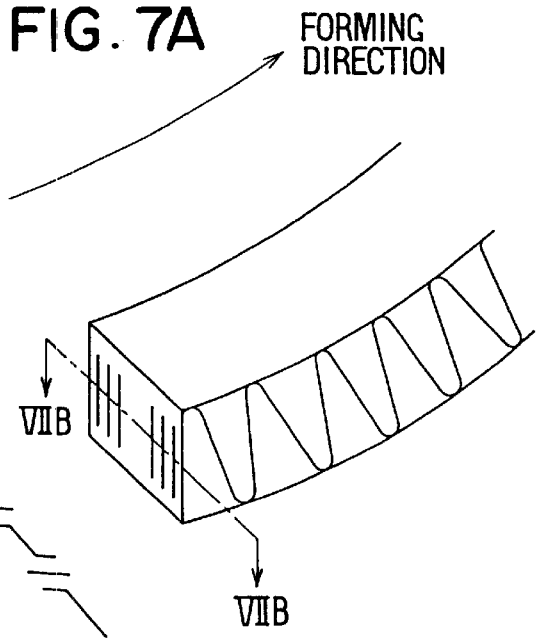
FIG. 7B

FIG. 12A
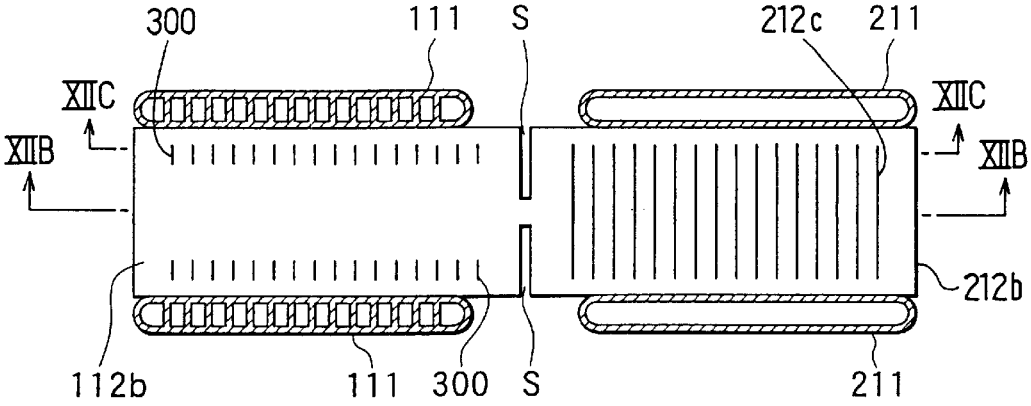
FIG. 12B
FIG. 12C
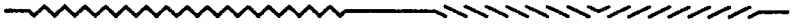
FIG. 13A
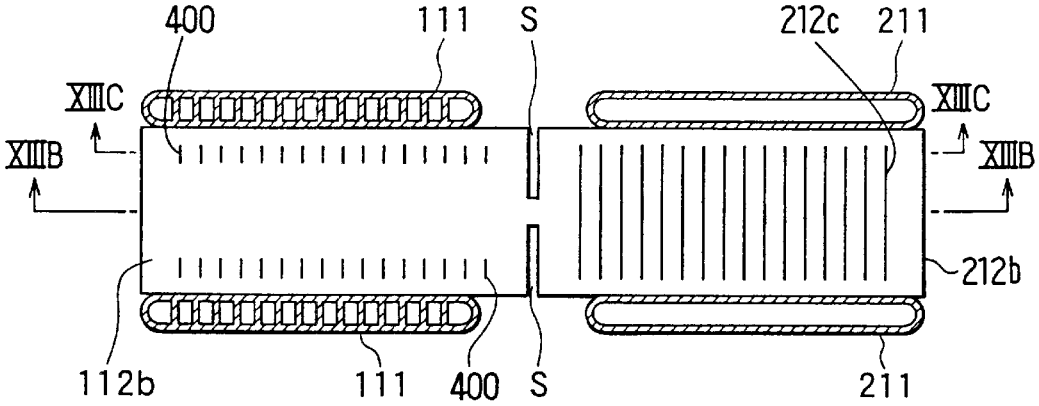
FIG. 13B
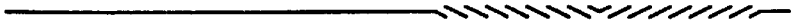
FIG. 13C
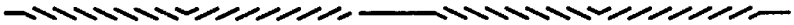

CORRUGATED FIN FOR HEAT EXCHANGER

CROSS REFERENCE TO RELATED APPLICATIONS

This application relates to and claims priority from Japanese Patent Application No. 11-24094 filed on Feb. 1, 1999, the contents of which are hereby incorporated by reference.

BACKGROUND OF THE INVENTION

1. Field of the Invention

The present invention relates generally to heat exchangers, and particularly to a fin for a double heat exchanger including two or more heat exchangers such as a condenser and a radiator.

2. Related Art

Conventionally, a fin for a heat exchanger is formed into a corrugated shape having plural bent portions and plural flat portions each of which connects the adjacent bent portions. The fin has plural louvers formed by partially cutting and raising each flat portion to increase a heat transfer rate of the fin.

FIGS. 14 and 15A show such a fin for a double heat exchanger including a condenser and a radiator, which was studied by the inventors. The fin includes a condenser fin 512 and a radiator fin 612 integrally formed. A louver-forming processing amount defined by the number of the louvers, a width of each louver or an inclining angle of each louver of the condenser fin 512 is differently set from that of the radiator fin 612, so that each of the condenser and the radiator has an appropriate heat-exchange performance. In FIGS. 14 and 15A, the number of the louvers formed in the condenser fin 512 is smaller than that of the radiator fin 612.

However, as shown in FIGS. 15A–15C, since the louvers are formed by partially cutting and raising each flat portion, when the louver-forming processing amount of the radiator fin 612 is larger than that of the condenser fin 512, each bent portion of the radiator fin 612 may be deformed to have a smaller radius of curvature R than that of the condenser fin 512. As a result, as shown in FIG. 14, the whole fin may be deformed into a bow shape so that a radius of curvature of the fin at a side of the radiator fin 612 is decreased. A fin for a heat exchanger having a single heater core such as a condenser or a radiator may also be deformed due to the same reason.

SUMMARY OF THE INVENTION

In view of the foregoing problems, it is an object of the present invention to provide a fin for a heat exchanger which is restricted from being deformed.

According to the present invention, a corrugated fin for a heat exchanger having a plurality of tubes through which a fluid flows is disposed between adjacent tubes. The fin includes a plurality of bent portions, and a plurality of flat portions each connecting adjacent bent portions. Each of the flat portions has a louver formed by partially cutting and raising each of the flat portions, and includes a first flat portion and a second flat portion. A processing amount of the first flat portion for forming the louver is smaller than that of the second flat portion, and the first flat portion has a plastically deformed portion formed by plasticity processing.

Therefore, a whole processing amount of the first flat portion is increased by the plastically deformed portion, and becomes substantially equal to that of the second flat portion. As a result, the fin is restricted from being deformed.

Preferably, the plastically deformed portion is formed adjacent to the bent portions in the first flat portion. As a result, the fin is further restricted from being deformed.

BRIEF DESCRIPTION OF THE DRAWINGS

This and other objects and features of the present invention will become more readily apparent from a better understanding of the preferred embodiments described below with reference to the accompanying drawings, in which:

FIG. 6A is a partial sectional view showing a core portion of a double heat exchanger according to a third preferred embodiment of the present invention, and FIG. 6B is a sectional view taken along line VIB—VIB in FIG. 6A;

FIG. 7A is a schematic partial perspective view showing a conventional fin for a heat exchanger, and FIG. 7B is a sectional view taken along line VIIB—VIIB in FIG. 7A;

FIG. 12A is a partial sectional view showing a core portion of a double heat exchanger according to a fifth preferred embodiment of the present invention, FIG. 12B is a sectional view taken along line XIIB—XIIB in FIG. 12A, and FIG. 12C is a sectional view taken along line XIIC—XIIC in FIG. 12A;

FIG. 13A is a partial sectional view showing a core portion of a double heat exchanger according to a modification of the fifth embodiment, FIG. 13B is a sectional view taken along line XIIIB—XIIIB in FIG. 13A, and FIG. 13C is a sectional view taken along line XIIIC—XIIIC in FIG. 13A;

DETAILED DESCRIPTION OF THE PREFERRED EMBODIMENTS

Preferred embodiments of the present invention are described hereinafter with reference to the accompanying drawings.

First Embodiment

A first preferred embodiment of the present invention will be described with reference to FIGS. 1–4. In the first embodiment, the present invention is applied to a fin for a double heat exchanger including a condenser 100 of a refrigeration cycle of a vehicle air conditioner, and a radiator 200 disposed at a downstream air side of the condenser 100 with respect to air passing through the double heat exchanger, for cooling engine coolant.

Figure 1:
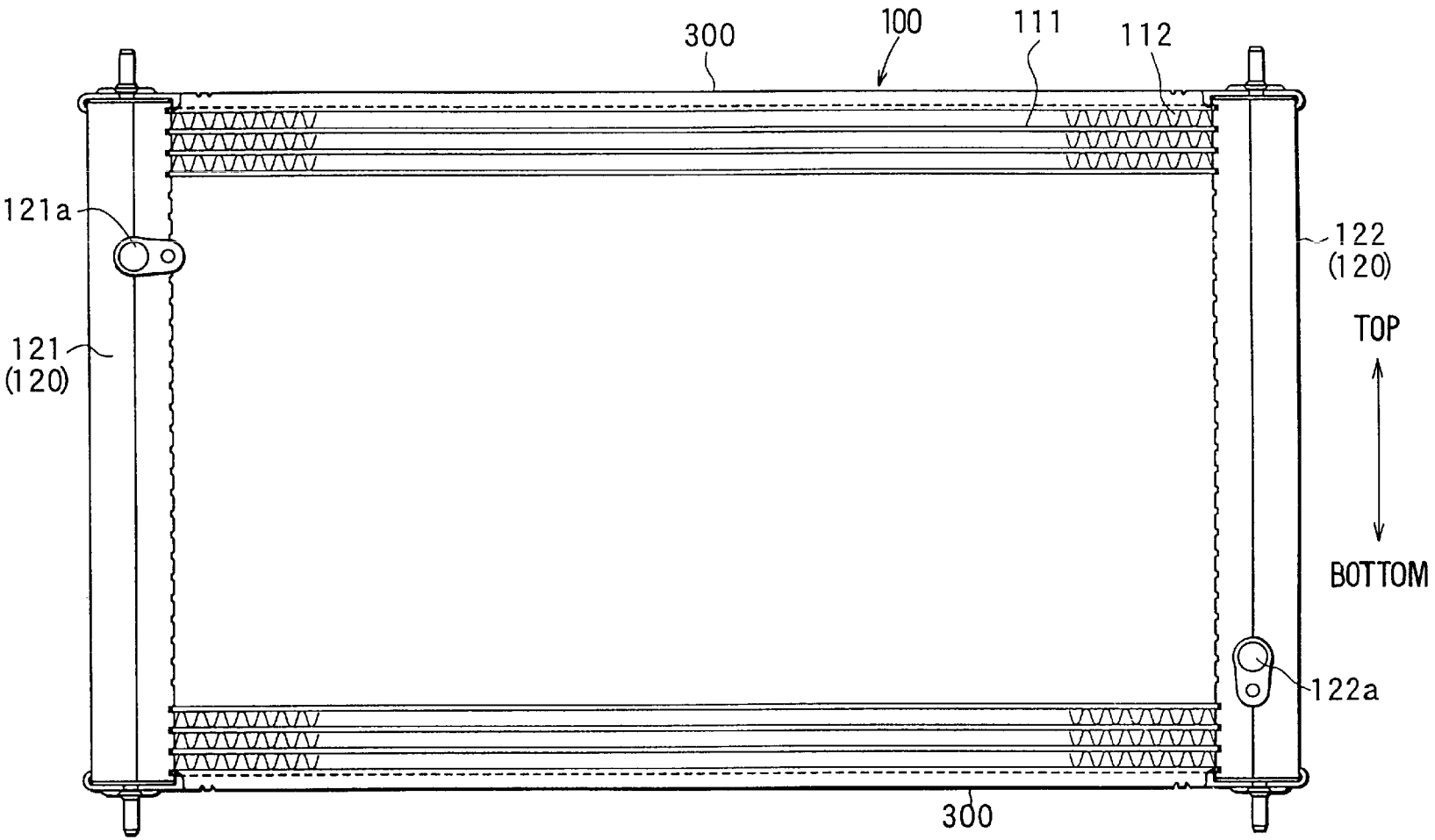
FIG. 1 is a front view showing a condenser of a double heat exchanger according to a first preferred embodiment of the present invention.
Figure 2:
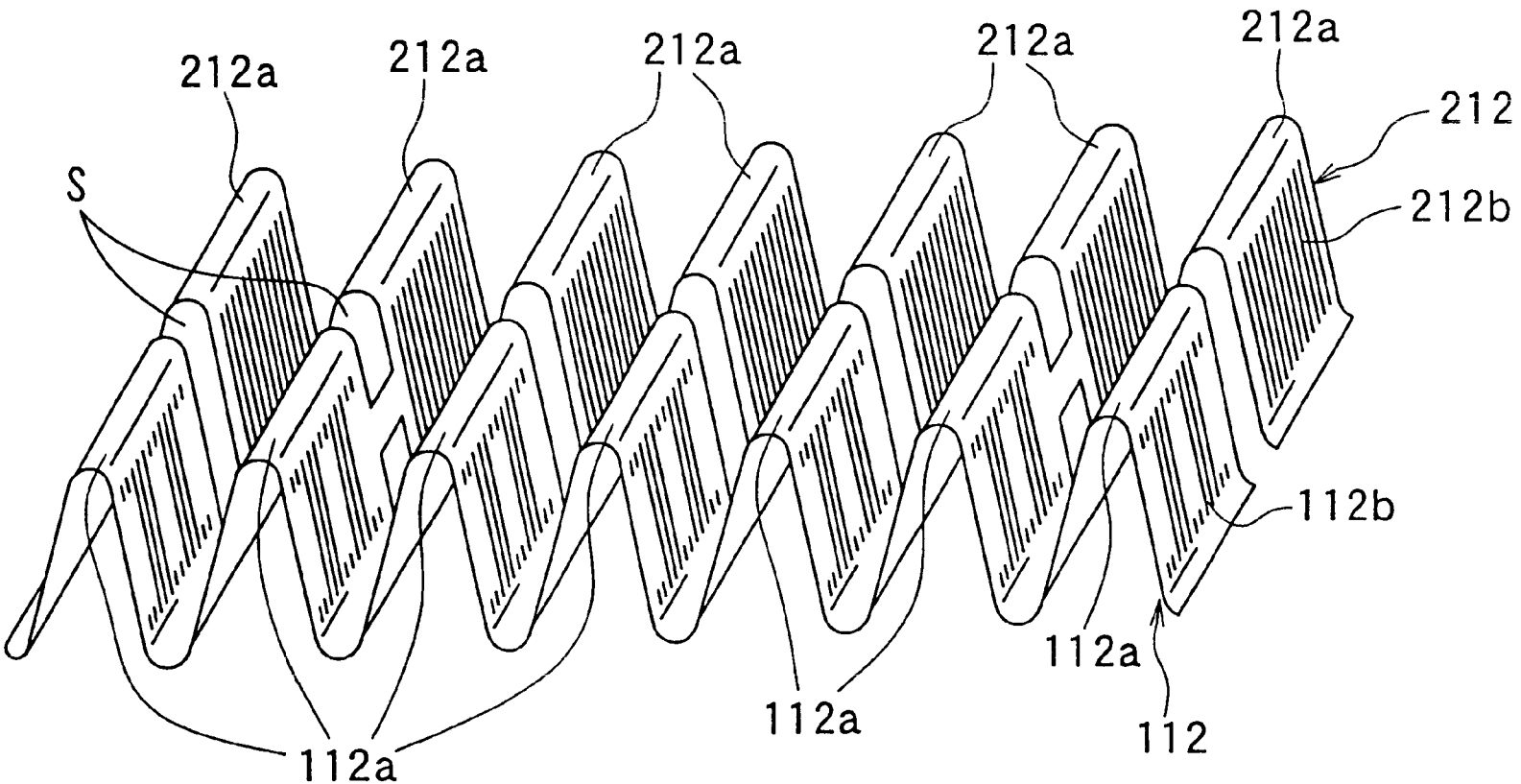
FIG. 2 is a perspective view showing a fin of the double heat exchanger according to the first embodiment.

In FIG. 1, the double heat exchanger is viewed from a side of the condenser 100, that is, from an upstream air side of the double heat exchanger. The condenser 100 has plural flat condenser tubes 111 through which refrigerant flows, and plural condenser fins 112 each of which is disposed between adjacent tubes 111 for facilitating heat-exchange between refrigerant and air. As shown in FIG. 2, each condenser fin 112 is formed into a corrugated shape, and has plural bent portions 112*a* and plural flat portions 112*b* each of which connects adjacent bent portions 112*a*. Each condenser fin 112 is brazed to the condenser tubes 111 by brazing material clad on a surface of the condenser tubes 111. The condenser tubes 111 and the condenser fins 112 form a condenser core 110 which condenses refrigerant.

As shown in FIG. 1, a first condenser tank 121 is disposed at one flow-path end of the condenser tubes 111 to extend in a direction perpendicular to a longitudinal direction of each condenser tube 111, and communicates with each condenser tube 111. The first condenser tank 121 has an inlet joint 121*a* connected to an outlet of an compressor (not shown). Refrigerant discharged from the compressor is introduced into the first condenser tank 121 through the inlet joint 121*a*, and is distributed to each condenser tube 111.

On the other hand, a second condenser tank 122 is disposed at the other flow-path end of the condenser tubes 111 to extend in the direction perpendicular to the longitudinal direction of each condenser tube 111, and communicates with each condenser tube 111. Refrigerant from each condenser tube 111 is collected into the second condenser tank 122. The second condenser tank 122 has an outlet joint 122*a* connected to an inlet of a decompressor (not shown). Hereinafter, the first and second condenser tanks 121, 122 are collectively referred to as a condenser tank 120.

Figure 3:
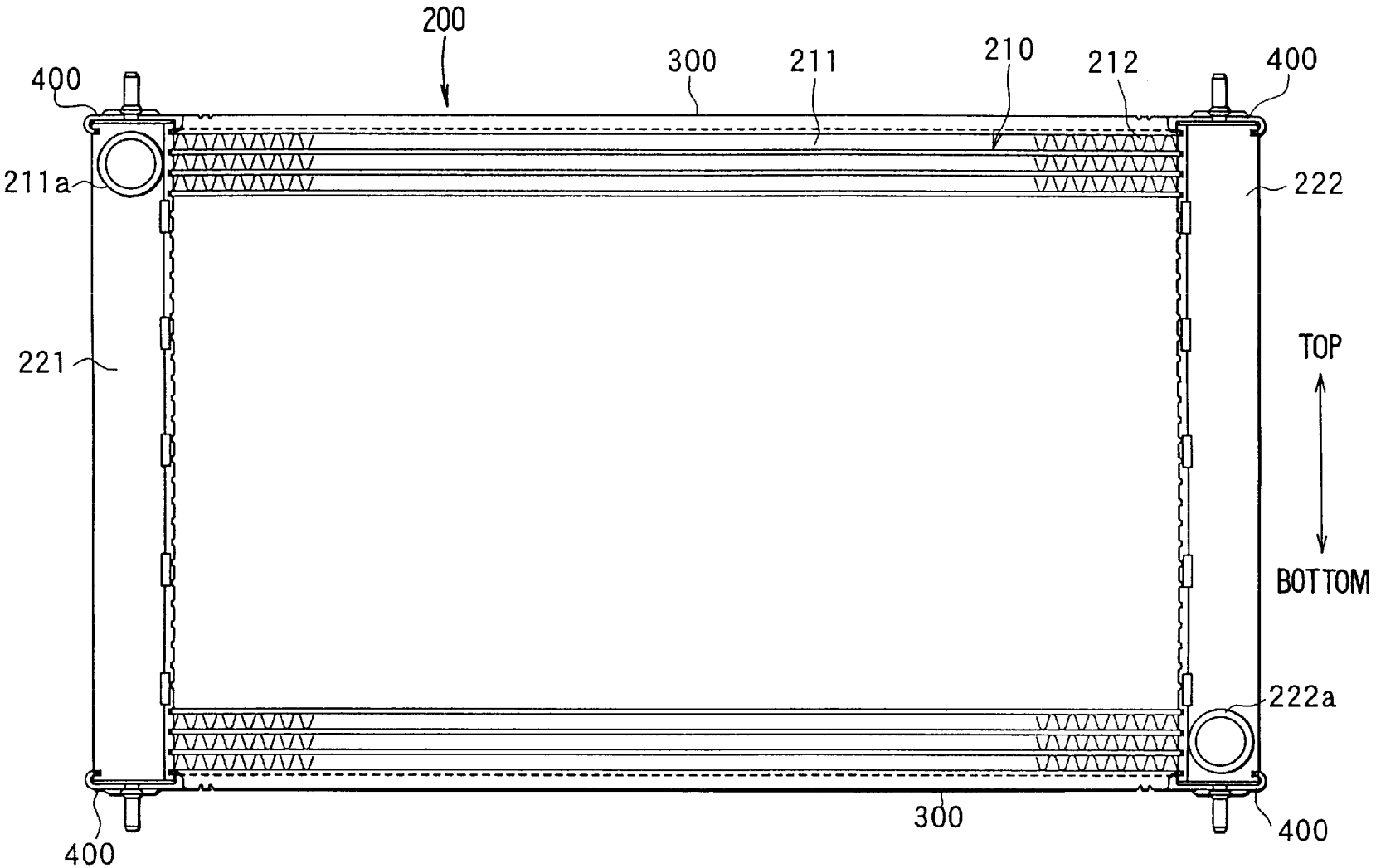
FIG. 3 is a front view showing a radiator of the double heat exchanger according to the first embodiment.

In FIG. 3, the double heat exchanger is viewed from a side of the radiator 200, that is, from a downstream air side of the double heat exchanger. The radiator 200 has plural flat tubes 211 through which coolant flows, and plural radiator fins 212 each of which is disposed between adjacent radiator tubes 211 for facilitating heat-exchange between coolant and air. As shown in FIG. 2, similarly to the condenser fin 211, each radiator fin 212 is formed into a corrugated shape, and has plural bent portions 212*a* and plural flat portions 212*b* each of which connects adjacent bent portions 212*a*.

Figure 4A:
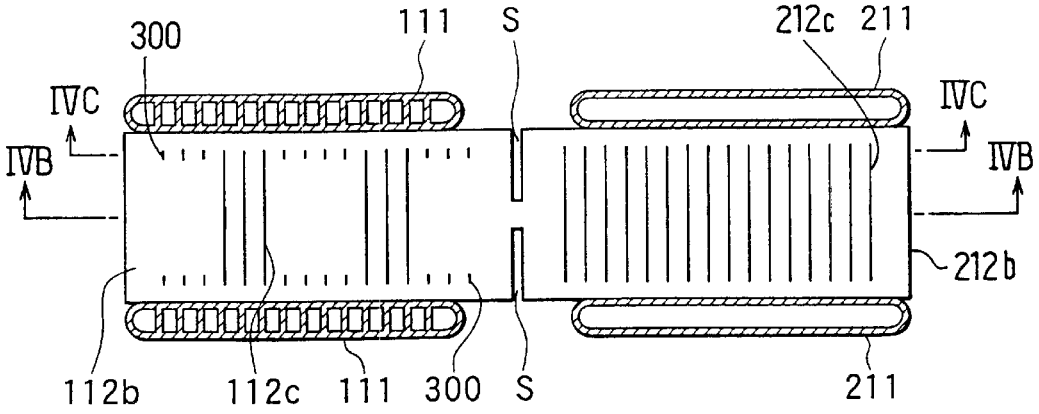
FIG. 4A is a partial sectional view showing a core portion of the double heat exchanger according to the first embodiment.
Figure 4B:
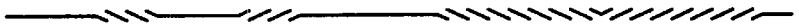
FIG. 4B is a sectional view taken along line IVB—IVB in FIG. 4A.
Figure 4C:
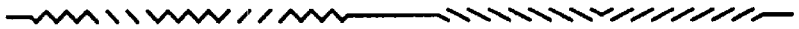
FIG. 4C is a sectional view taken along line IVC—IVC in FIG. 4A.

As shown in FIGS. 2 and 4, the radiator fin 212 is integrally formed with the condenser fin 112. A slit S is formed between the condenser fin 112 and the radiator fin 212 so that heat is restricted from being transferred from the radiator fin 212 to the condenser fin 112. That is, in the first embodiment, the condenser fin 112 is disposed at one side of the slit S as a reference line, and the radiator fin 212 is disposed at the other side of the slit S. The slit S is formed by cutting out a portion between the condenser fin 112 and the radiator fin 212, and extends in a direction perpendicular to a ridge of each bent portion 112*a*, 212*a*.

Further, as shown in FIGS. 2 and 4, each flat portion 112*b*, 212*b* of the condenser and radiator fins 112, 212 respectively has plural louvers 112*c*, 212*c* formed by partially cutting and raising each flat portion 112*b*, 212*b*, to improve heat transfer rates of the condenser and radiator fins 112, 212. In the first embodiment, the number of the louvers 112*c* of each flat portion 112*b* is set smaller than the number of the louvers 212*c* of each flat portion 212*b*. As a result, a louver-forming processing amount of the condenser fin 112 is smaller than that of the radiator fin 212.

Further, each flat portion 112*b* of the condenser fin 112 has plural plastically deformed portions 300 formed by a plasticity processing such as coining, into a dimple or wave shape. The plastically deformed portions 300 are formed adjacent to the bent portions 112*a* in each flat portion 112*b*, and are formed simultaneously with the louvers 112*c* by a forming roller.

Referring back to FIG. 3, each radiator fin 212 is brazed to the radiator tubes 211 by brazing material clad on a surface of the radiator tubes 211. The radiator tubes 211 and the radiator fins 212 form a radiator core 210 which cools coolant. A first radiator tank 221 is disposed at one flowpath end of the radiator tubes 211 to extend in parallel with the condenser tank 120, and communicates with each radiator tuba 211. The first radiator tank 221 has an inlet pipe 221*a* connected to an outlet of an engine (not shown). Coolant from the engine is introduced into the first radiator tank 221 through the inlet pipe 221*a*, and is distributed to each radiator tube 211.

On the other hand, a second radiator tank 222 is disposed at the other flow-path end of the radiator tubes 211 to extend in parallel with the condenser tank 120, and communicates with each radiator tube 211. Coolant from each radiator tube 211 is collected into the second radiator tank 222. The second radiator tank 222 has an outlet pipe 222*a* connected to an inlet of the engine.

According to the first embodiment, each flat portion 112*b* of the condenser fin 112 having a less number of louvers 112*c* than each flat portion 212*b* of the radiator fin 212 has the plastically deformed portions 300. As a result, even when the louver-forming processing amount of the condenser fin 112 is smaller than that of the radiator fin 212, a whole processing amount of the condenser fin 112 is increased by the plastically deformed portions 300 to become substantially equal to that of the radiator fin 212. Therefore, an integrated fin including the condenser fin 112*b* and the radiator fin 212*b* is restricted from being deformed into a bow shape.

When the processing amount of the flat portion 112*b* is increased in the vicinity of each bent portion 112*a*, a radius of curvature R of each bent portion 112*a* is effectively decreased. In the first embodiment, the plastically deformed portions 300 are formed adjacent to each bent portion 112*a* in each flat portion 112*b*, that is, adjacent to each end of width of the louvers 112*c*. Therefore, the integrated fin is further restricted from being deformed.

Second Embodiment

Figure 5A:
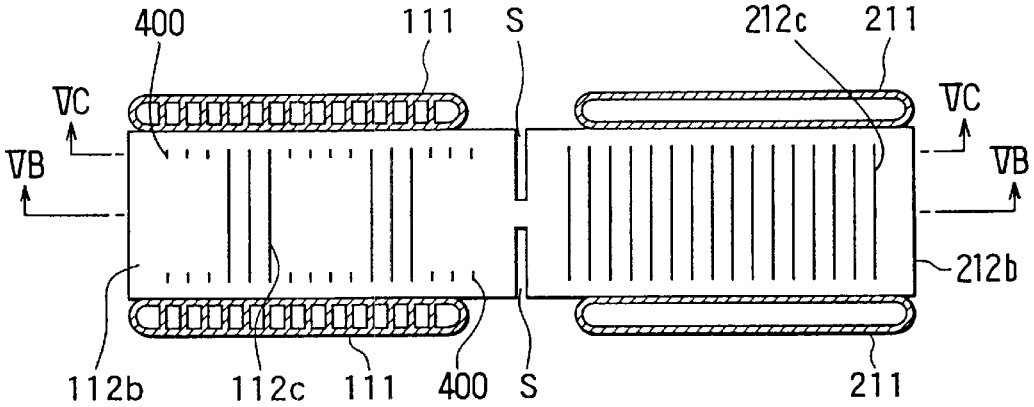
FIG. 5A is a partial sectional view showing a core portion of a double heat exchanger according to a second preferred embodiment of the present invention.
Figure 5B:
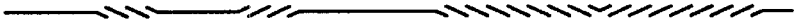
FIG. 5B is a sectional view taken along line VB—VB in FIG. 5A.
Figure 5C:
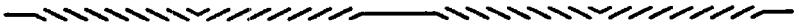
FIG. 5C is a sectional view taken along line VC—VC in FIG. 5A.

A second preferred embodiment of the present invention will be described with reference to FIG. 5. In this and the following embodiments, components which are substantially the same as those in previous embodiments are assigned to the same reference numerals.

In the second embodiment, plural plastically deformed portions 400 are formed by partially cutting each flat portion 112*c* of the condenser fin 112 so that air passes through the plastically deformed portions 400. According to the second embodiment, not only the same effect as in the first embodiment is obtained, but also a heat transfer rate of the condenser fin 112 is improved, thereby improving heat-exchange performance of the condenser 100.

Third Embodiment

A third preferred embodiment of the present invention will be described with reference to FIG. 6.

In the third embodiment, as shown in FIG. 6, the louvers 112*c* of the condenser fin 112 are formed only at an end (i.e., a left end in FIG. 6) of each flat portion 112*b* opposite to a slit side end thereof. According to the third embodiment, although the louver-forming processing amount of the condenser fin 112 is not equal to that of the radiator fin 212, a bending moment for bending the integrated fin so that a radius of curvature of the integrated fin at the side of the radiator fin 212 is decreased is offset by a bending moment for bending the integrated fin so that a radius of curvature of the integrated fin at the side of the condenser fin 112 is decreased. As a result, the integrated fin is restricted from being deformed into a bow shape.

Fourth Embodiment

A fourth preferred embodiment of the present invention will be described with reference to FIGS. 7–11.

As shown in FIG. 7, generally, a louver of a corrugated fin is formed by cutting a flat portion of the fin and inclining the cut portion with respect to the flat portion. Therefore, when the cut portion is inclined, a bending moment is applied to the fin in a direction in which the cut portion is inclined, and the integrated fin is deformed. The deformed direction of the fin generally depends on an inclining direction of the cut portion.

Figure 8A:
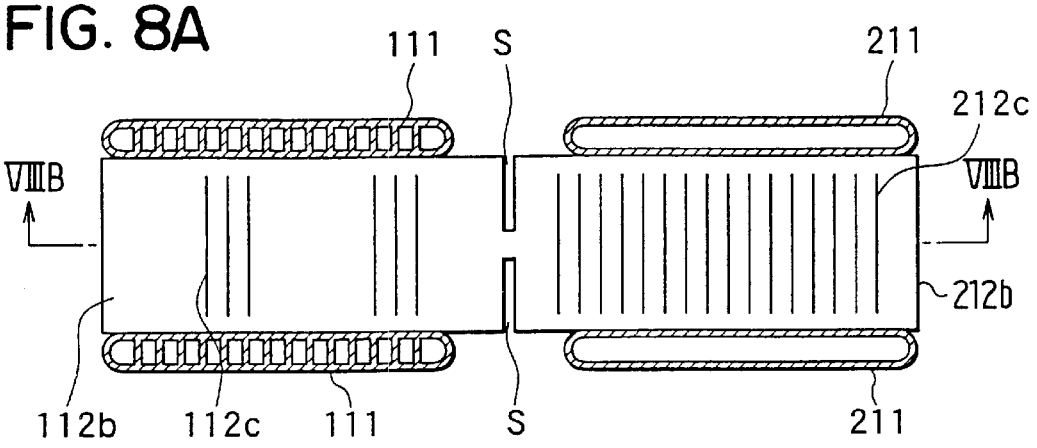
FIG. 8A is a partial sectional view showing a core portion of a double heat exchanger according to a fourth preferred embodiment of the present invention.
Figure 8B:
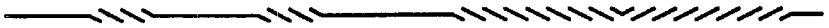
FIG. 8B is a sectional view taken along line VIIIB—VIIIB in FIG. 8A.

In the fourth embodiment, as shown in FIG. 8, a right half of the louvers 112*c* of the condenser fin 112 formed at a right side in FIG. 8 adjacent to the slid S are inclined in an opposite direction to those in the first embodiment shown in FIG. 4. As a result, in FIG. 8, an inclining direction of the right half of the louvers 112*c* of the condenser fin 112 is opposite to that of a right half of the louvers 212*c* of the radiator fin 212 formed away from the slit S.

Figure 9A:
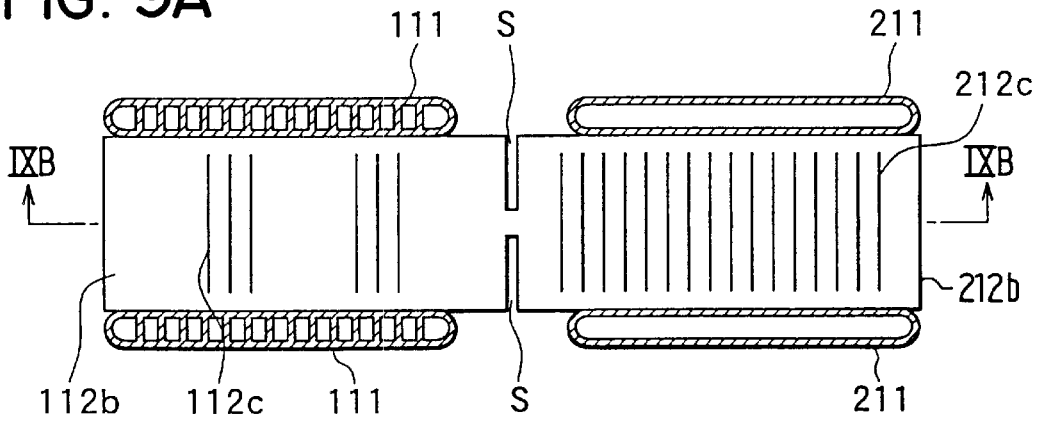
FIG. 9A is a partial sectional view showing a core portion of a double heat exchanger according to a modification of the fourth embodiment.
Figure 9B:
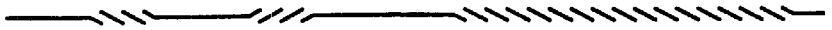
FIG. 9B is a sectional view taken along line IXB—IXB in FIG. 9A.
Figure 10A:
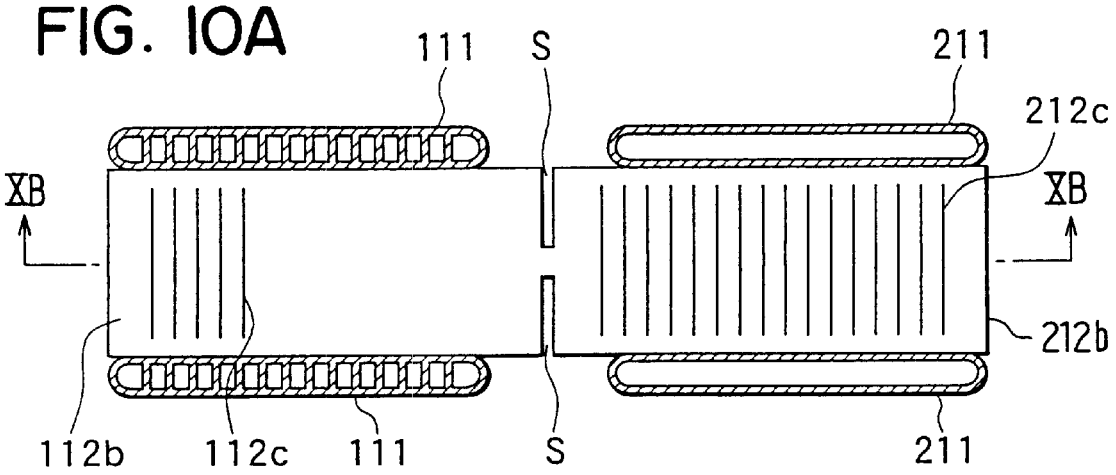
FIG. 10A is a partial sectional view showing a core portion of a double heat exchanger according to a modification of the fourth embodiment.
Figure 10B:
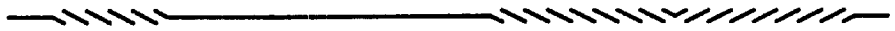
FIG. 10B is a sectional view taken along line XB—XB in FIG. 10A.
Figure 11A:
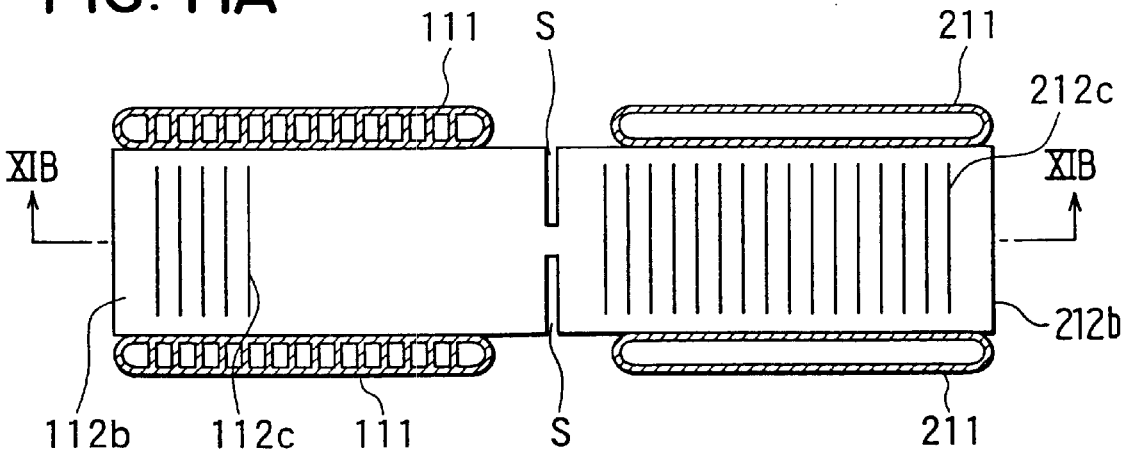
FIG. 11A is a partial sectional view showing a core portion of a double heat exchanger according to a modification of the fourth embodiment.
Figure 11B:
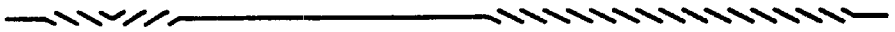
FIG. 11B is a sectional view taken along line XIB—XIB in FIG. 11A.
Figure 14:
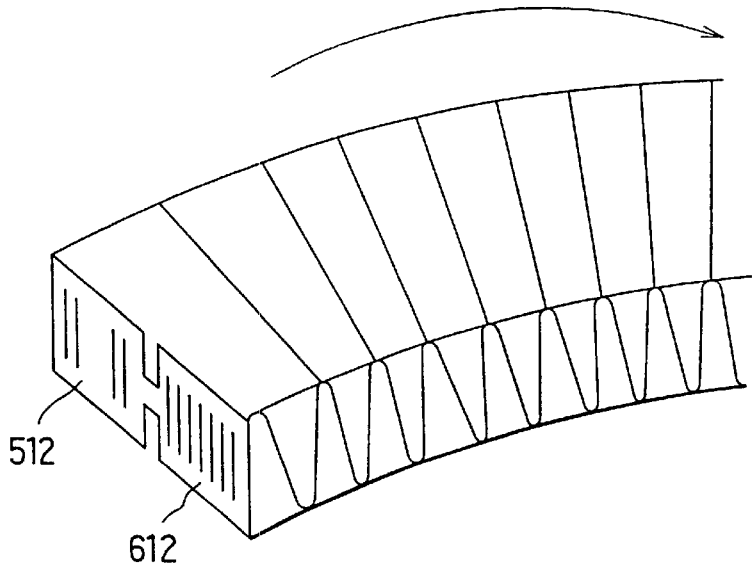
FIG. 14 RELATED ART
FIG. 14 is a schematic partial perspective view showing a conventional fin for a heat exchanger.
Figure 15A:
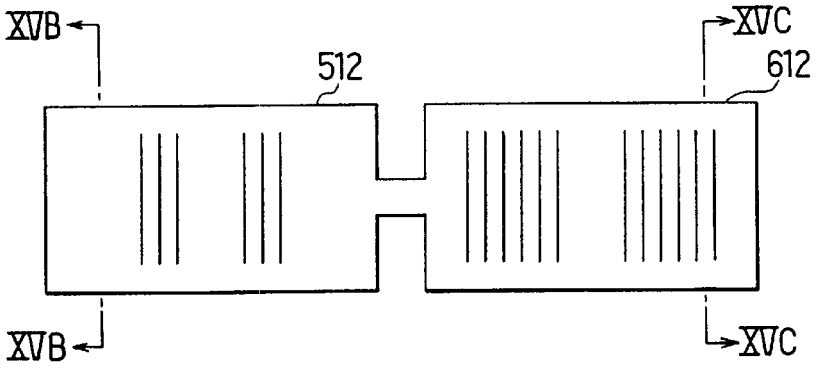
FIG. 15A RELATED ART
FIG. 15A is a side view showing the fin in FIG. 14.
Figure 15B:
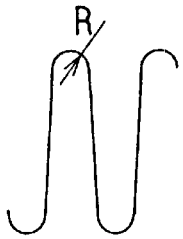
FIG. 15B RELATED ART
FIG. 15B is a sectional view taken along line XVB—XVB in FIG. 15A.
Figure 15C:
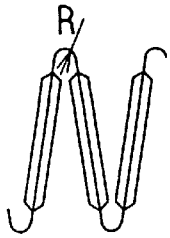
FIG. 15C RELATED ART
FIG. 15C is a sectional view taken along line XVC—XVC in FIG. 15A.

According to the fourth embodiment, the bending moment for bending the integrated fin is offset when the louvers 112*c*, 212*c* are formed as described-above. As a result, the integrated fin is restricted from being deformed. In the fourth embodiment, as shown in FIG. 9, a right half of the louvers 212*c* of the radiator fin 212 formed away from the slit S may be inclined in an opposite direction to those in the first embodiment shown in FIG. 4. As a result, in FIG. 9, an inclining direction of a right half of the louvers 112*c* of the condenser fin 112 formed adjacent to the slit S is opposite to that of the right half of the louvers 212*c* of the radiator fin 212 formed away from the slit S. Further, as shown in FIGS. 10 and 11, the louvers 112*c* of the condenser fin 112 may be formed only at an end of each flat portion 112*b* opposite to the slit side end thereof.

Fifth Embodiment

A fifth preferred embodiment of the present invention will be described with reference to FIGS. 12 and 13.

In the fifth embodiment, the present invention is applied to a heat exchanger in which the condenser fin 112 has no louvers 112*c*. As shown in FIGS. 12 and 13, the flat portion 112*b* of the condenser fin 112 has no louvers 112*c*, and has plural plastically deformed portions 300/400. According to the fifth embodiment, similarly to the first and second embodiments, the integrated fin is restricted from being deformed. In FIG. 12, each plastically deformed portion 300 is formed into a dimple shape, similarly to the first embodiment. In FIG. 13, the plastically deformed portions 400 are formed by cutting so that air passes through the plastically deformed portions 400, similarly to the second embodiment.

The present invention may be applied to a fin for a heat exchanger having a single heater core and plural tubes such as a condenser or a radiator. In this case, since there is no slit S in the fin, a virtual line extending perpendicular to a ridge of each bent portion 112*a*, 212*a* is used as a reference line.

Further, in the above-described embodiments, the slit S may not create a predetermined gap between the condenser fin 112 and the radiator fin 212, and may be formed by simply cutting the integrated fin with a certain depth between the condenser fin 112 and the radiator fin 212. Also, the number of the louvers 112*c* of the condenser fin 112 may be set larger than the number of the louvers 212*c* of the radiator fin 212.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A corrugated fin for a heat exchanger having a plurality of tubes through which a fluid flows, the fin being disposed between adjacent tubes, the fin comprising:

a plurality of bent portions; and a plurality of flat portions each connecting adjacent bent portions to form the corrugated fin, each of the flat portions having a louver formed by partially cutting and raising each of the flat portions, and including a first flat portion and a second flat portion; wherein:

a processing amount of the first flat portion for forming the louver is smaller than a processing amount of the second flat portion for forming the louver;

the first flat portion has a closed plastically deformed portion formed by plasticity processing; and the plastically deformed portion is a concave-convex portion.

2. The fin according to claim 1, wherein the first flat portion is disposed at one side of a reference line extending substantially perpendicular to a ridge of each of the bent portions, and the second flat portion is disposed at the other side of the reference line.

3. The fin according to claim 1, wherein each tube is formed into a flat shape.

4. The fin according to claim 1, wherein the plastically deformed portion is formed into a dimple shape.

5. A corrugated fin for a double heat exchanger having a plurality of first tubes through which a first fluid flows, and a plurality of second tubes through which a second fluid flows, the fin comprising:

a first fin disposed between adjacent first tubes, the first fin including a plurality of first bent portions, and a plurality of first flat portions each connecting adjacent first bent portions and having a louver formed by partially cutting and raising each of the first flat portions; and a second fin disposed between adjacent second tubes and formed integrally with the first fin, the second fin including a plurality of second bent portions, and a plurality of second flat portions each connecting adjacent second bent portions and having a louver formed by partially cutting and raising each of the second flat portions, wherein:

a processing amount of one of the first flat portions for forming the louver is smaller than that of one of the second flat portions integrated with the one of the first flat portions;

the one of the first flat portions has a plastically deformed portion formed by plasticity processing; and the plastically deformed portion is a concave-convex portion.

6. The fin according to claim 5, wherein the plastically deformed portion is formed only on the one of the first flat portions.

7. The fin according to claim 5, wherein the second tubes are disposed at a downstream air side of the first tubes with respect to air passing through the double heat exchanger.

8. The fin according to claim 5, wherein the first tubes are disposed at a downstream air side of the second tubes with respect to air passing through the double heat exchanger.

9. The fin according to claim 5, wherein the double heat exchanger includes a condenser composed of the first tubes and a radiator composed of the second tubes.

10. The fin according to claim 5, wherein the processing amount is defined by the number of the louver.

11. The fin according to claim 5, wherein each of the first tubes and the second tubes is formed into a flat shape.

12. The fin according to claim 5, wherein the plastically deformed portion is formed adjacent to the bent portions.

13. A corrugated fin for a heat exchanger having a plurality of tubes through which a fluid flows, the fin being disposed between adjacent tubes, the fin comprising:

a plurality of bent portions; and a plurality of flat portions each connecting adjacent bent portions to form the corrugated fin, each of the flat portions having a louver formed by partially cutting and raising each of the flat portions, and including a first flat portion and a second flat portion, wherein:

a processing amount of the first flat portion for forming the louver is smaller than a processing amount of the second flat portion for forming the louver;

the first flat portion has a plastically deformed portion formed by plastically processing; and a length of the plastically deformed portion is smaller than a length of the louver.

14. A corrugated fin for a double heat exchanger having a plurality of first tubes through which a first fluid flows, and a plurality of second tubes through which a second fluid flows, the fin comprising:

a first fin disposed between adjacent first tubes, the first fin including a plurality of first bent portions, and a plurality of first flat portions each connecting adjacent first bent portions and having a louver formed by partially cutting and raising each of the first flat portions; and a second fin disposed between adjacent second tubes and formed integrally with the first fin, the second fin including a plurality of second bent portions, and a plurality of second flat portion each connecting adjacent second bent portions and having a louver formed by partially cutting and raising each of the second flat portions, wherein:

a processing amount of one of the first flat portions for forming the louver is smaller than that of one of the second flat portions integrated with the one of the first flat portions;

the one of the first flat portions has a plastically deformed portion formed by plastically processing; and a length of the plastically deformed portion is smaller than a length of the louver.

15. A corrugated fin for a heat exchanger having a plurality of tubes through which a fluid flows, the fin being disposed between adjacent tubes, the fin comprising:

a plurality of bent portions; and a plurality of flat portions each connecting adjacent bent portions to form the corrugated fin, each of the flat portions having a louver formed by partially cutting and raising each of the flat portions, and including a first flat portion and a second flat portion; wherein:

a processing amount of the first flat portion for forming the louver is smaller than a processing amount of the second flat portion for forming the louver;

the first flat portion has a plastically deformed portion formed by plastically processing; and the plastically deformed portion is formed adjacent to the bent portions.

16. A corrugated fin for a double heat exchanger having a plurality of first tubes through which a first fluid flows, and a plurality of second tubes through which a second fluid flows, the fin comprising:

a first fin disposed between adjacent first tubes, the first fin including a plurality of first bent portions, and a plurality of first flat portions each connecting adjacent first bent portions and having a louver formed by partially cutting and raising each of the first flat portions; and a second fin disposed between adjacent second tubes and formed integrally with the first fin, the second fin including a plurality of second bent portions, and a plurality of second flat portion each connecting adjacent second bent portions and having a louver formed by partially cutting and raising each of the second flat portions; wherein:

a processing amount of one of the first flat portions for forming the louver is smaller than that of one of the second flat portions integrated with the one of the first flat portions;

the one of the first flat portions has a plastically deformed portion formed by plastically processing; and the plastically deformed portion is formed adjacent to the bent portions.

17. A corrugated fin for a heat exchanger having a plurality of tubes through which a fluid flows, the fin being disposed between adjacent tubes, the fin comprising:

a plurality of bent portions; and a plurality of flat portions each connecting adjacent bent portions to form the corrugated fin, each of the flat portions having a louver formed by partially cutting and raising each of the flat portions, and including a first flat portion and a second flat portion; wherein:

a processing amount of the first flat portion for forming the louver is smaller than a processing amount of the second flat portion for forming the louver; and the first flat portion has a closed plastically deformed portion formed by plasticity processing.

* * * * *